US010279243B2

(12) United States Patent
Choi

(10) Patent No.: US 10,279,243 B2
(45) Date of Patent: May 7, 2019

(54) SKATEBOARD WITH HAND BRAKE

(71) Applicant: Young Jin Choi, Lima (PE)

(72) Inventor: Young Jin Choi, Lima (PE)

( * ) Notice: Subject to any disclaimer, the term of this patent is extended or adjusted under 35 U.S.C. 154(b) by 0 days.

(21) Appl. No.: 15/831,982

(22) Filed: Dec. 5, 2017

(65) Prior Publication Data

US 2018/0318699 A1 Nov. 8, 2018

Related U.S. Application Data

(60) Provisional application No. 62/437,020, filed on Dec. 20, 2016.

(51) Int. Cl.
*A63C 17/14* (2006.01)
*A63C 17/01* (2006.01)

(52) U.S. Cl.
CPC ..... *A63C 17/1436* (2013.01); *A63C 17/01* (2013.01); *A63C 2017/1472* (2013.01)

(58) Field of Classification Search
CPC ... A63C 17/01; A63C 17/265; A63C 17/1436; A63C 17/1445; A63C 2017/1472; B60T 1/14
See application file for complete search history.

(56) References Cited

U.S. PATENT DOCUMENTS 1,075,250 A * 10/1913 Gingold ..... B62K 3/002 280/7.14
1,244,169 A * 10/1917 Brigel ..... A63C 17/01 280/87.042
1,247,801 A * 11/1917 Egge ..... A63C 17/01 280/11.209
2,330,147 A 9/1943 Rodriguez
4,043,566 A * 8/1977 Johnson ..... A63C 17/01 188/5
4,054,296 A 10/1977 Sullins
4,076,266 A * 2/1978 Krausz ..... A63C 17/01 16/35 R
4,093,252 A 6/1978 Rue et al.
4,166,519 A 9/1979 Maloney
4,167,225 A * 9/1979 Fragoso ..... B62K 3/002 188/5
4,179,134 A 12/1979 Atkinson
4,183,546 A * 1/1980 Heilig ..... A63C 17/01 280/11.212
4,775,162 A * 10/1988 Chao ..... A63C 17/01 280/267
4,951,958 A * 8/1990 Chao ..... A63C 17/26 188/16
5,253,882 A * 10/1993 Mitchell ..... A63C 17/1436 188/5
6,035,976 A * 3/2000 Duhamel ..... B60T 1/14 188/5

(Continued)

*Primary Examiner* — Frank B Vanaman
(74) *Attorney, Agent, or Firm* — Brett A. Schenck

(57) ABSTRACT

A skateboard with hand brake comprises a skateboard, a handle and a hand brake. A skateboard can be an ordinary skateboard or an electric motor skateboard. The handlebar has an "L" shape. The end of the lower part of the handle is fitted to the hanger of the front truck of the skateboard. A hand brake comprises a brake lever, a brake cable and a brake module. A brake lever is fitted to the upper part of the handle and a brake cable connects the brake lever to the brake module that is fitted underneath the deck.

7 Claims, 3 Drawing Sheets

(56) References Cited

U.S. PATENT DOCUMENTS

| | | | | |
|---|---|---|---|---|
| 6,367,828 | B1 * | 4/2002 | Mandic | B60T 1/14 280/87.05 |
| 6,820,881 | B1 | 11/2004 | Berry | |
| 2005/0173879 | A1 * | 8/2005 | Park | A63C 17/01 280/87.041 |
| 2005/0230929 | A1 * | 10/2005 | Chen | A63C 17/01 280/87.05 |

* cited by examiner

SKATEBOARD WITH HAND BRAKE

The present applications claims priority to the earlier filed provisional application having Ser. No. 62/437,020, and hereby incorporates subject matter of the provisional application in its entirety.

BACKGROUND OF THE INVENTION

1. Field of the Invention

The invention relates to a skateboard, in particular to a skateboard that is fitted with a brake that is activated by a brake lever mounted on a handle where the handle is fitted to the hanger of a truck of the skateboard.

2. Description of the Prior Art

Riding a skateboard may come with difficulty and at times may cause injury by falling off the skateboard due to the loss of body balance.

Providing a brake and a handle to the rider can help prevent losing balance in many cases.

Past efforts directed at providing handlebar structure are found in U.S. Pat. No. 4,179,134 to Atkinson, U.S. Pat. No. 4,093,252 to Rue and U.S. Pat. No. 2,330,147 to Rodriguez.

All previous arts on handles describe handles secured on the deck and not to the hanger of a truck.

A rider is able to maintain balance much easier if the handle stays independent to the deck motion by fitting it to the hanger of a truck.

Past efforts directed at providing brake structure are found in U.S. Pat. No. 6,820,881 to Berry, U.S. Pat. No. 4,166,519 to Maloney and U.S. Pat. No. 4,054,296 to Sullins.

All previous arts on skateboard brake systems refer to those acted by foot while this instant invention uses a hand brake system.

SUMMARY OF THE INVENTION

It is the main object of this present invention to give better stability and control of a skateboard by adding a handle and a brake system onto it.

DETAILED DESCRIPTION OF THE PREFERRED EMBODIMENT

Figure 1:
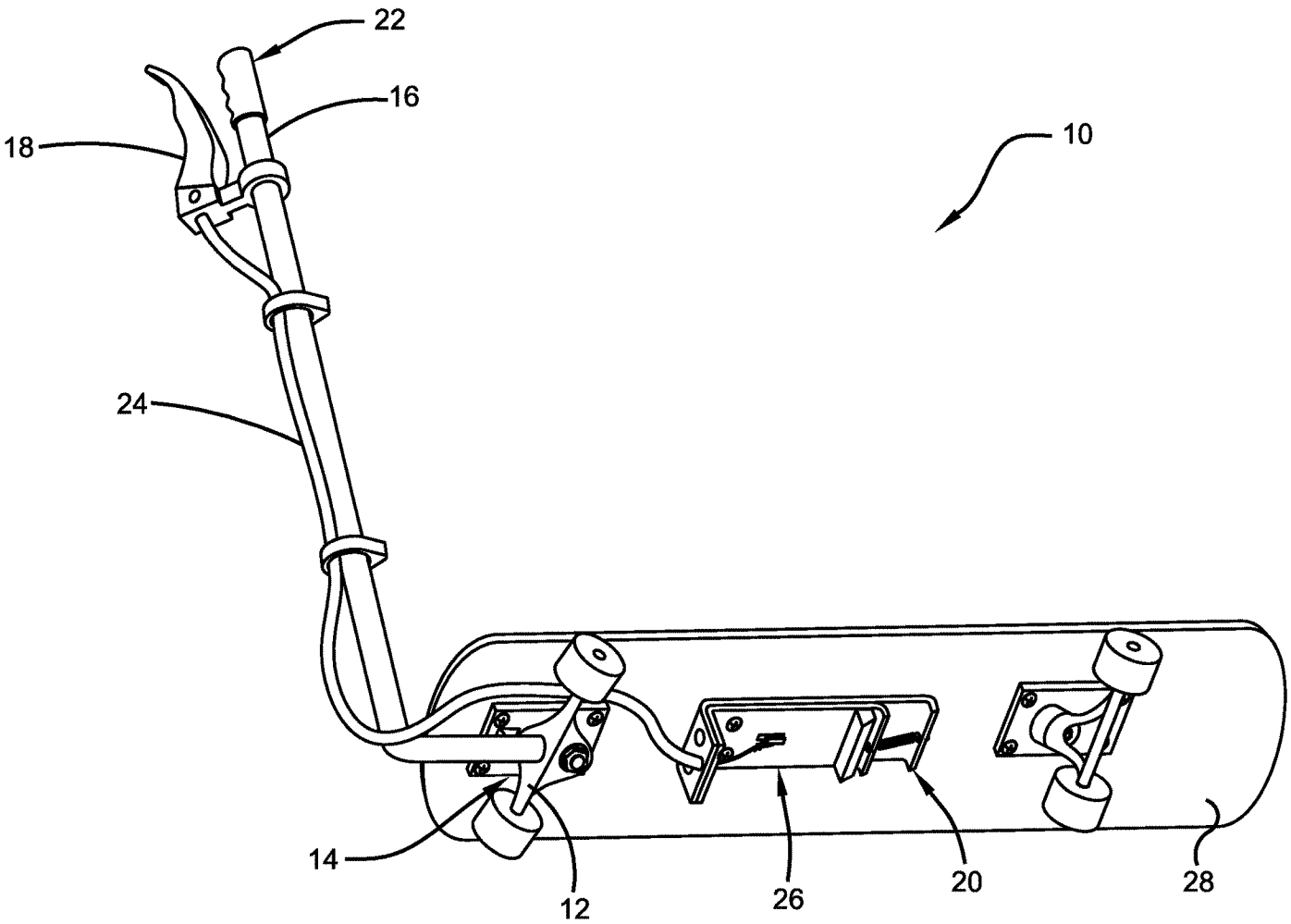
FIG. 1 shows a perspective bottom view of the skateboard with a handle and brake.

Referring to the drawings, FIG. 1 shows a handle 16 that is fitted to the hanger 12 of the truck 14 of a skateboard 10.

The handle 16 is bent upwards and extends to a certain height that gives a comfortable grip to a rider.

A brake lever 18 for the brake 20 is mounted on the handle 16 near the handlebar 22.

A brake cable 24 connects the brake lever 18 to the brake module 26 underneath the deck 28.

Figure 2:
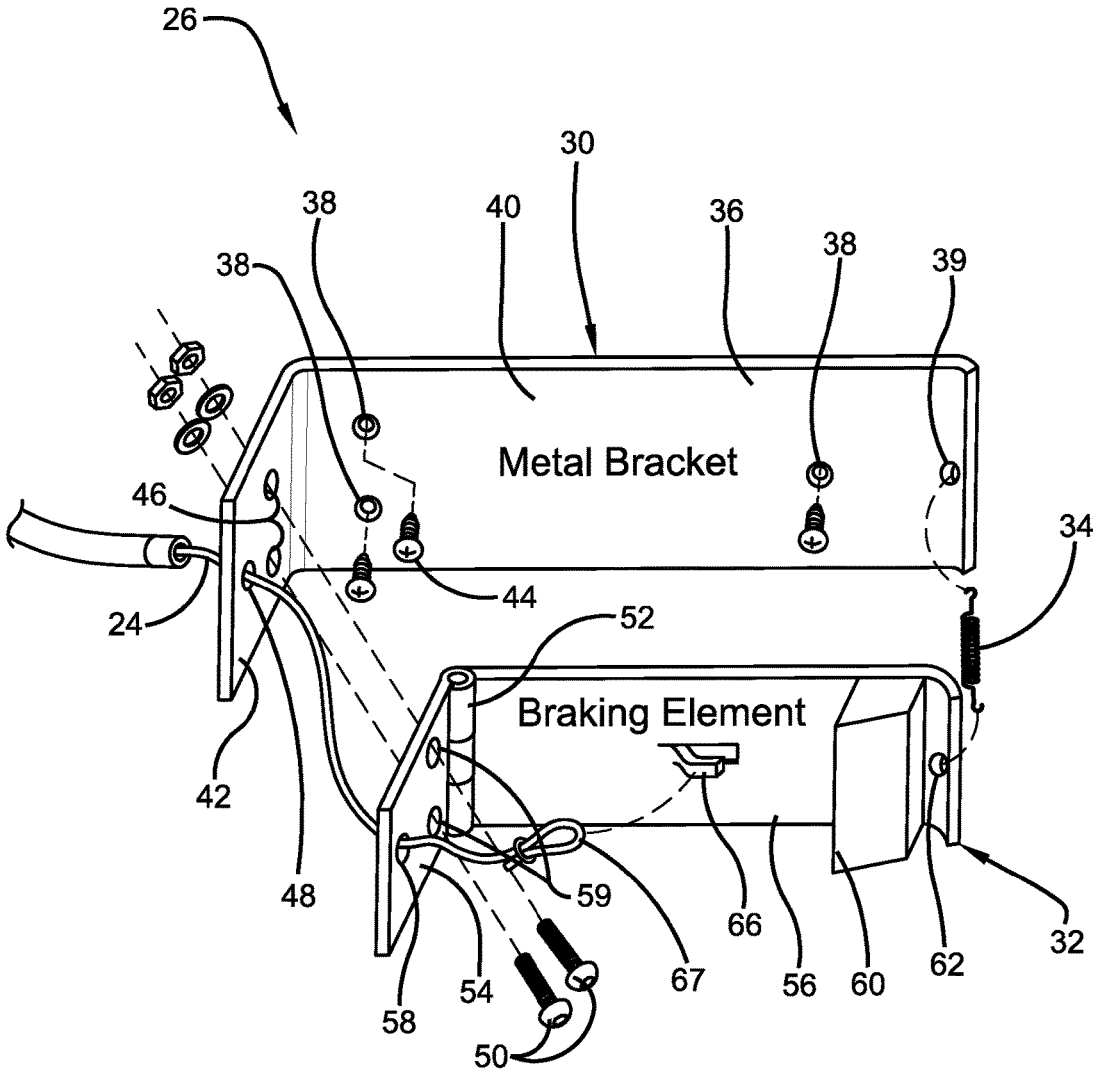
FIG. 2 shows an analytical view of a brake module.

FIG. 2 shows parts that form a brake module 26 that comprises a metal bracket 30, a braking element 32 and a spring 34.

The metal bracket 30 is an "L" shaped metal plate 36 with holes 38, 39, 46, 48 on both faces 40, 42.

One face 40 of the metal bracket 30 has 4 or more holes 38, 39 where 1 hole 39 is used to hold the spring 34 and the rest for screws 44 that are used for fixing the bracket 30 to the deck 28.

The other face 42 of the bracket 30 has 3 or more holes 46, 48 where 1 hole 48 is used to let through the brake cable 24 and the rest to let bolts 50 to fix the bracket 30 to the braking element 32.

A braking element 32 comprises a hinge 52 connected two rectangular metal to two rectangular metal plates 54, 56 where one plate is a fixed plate 54 and the other one a moving plate 56.

The fixed plate 54 has same number of holes 58, 59 at same positions as its counterpart face of the metal bracket 30 to let through the brake cable 24 and the fixing bolts 50.

The moving plate 56 has a piece of rubber type braking material 60 attached to the end section, a hole 62 at its external end to connect to the spring 34 and a notch hook 66 that holds end part 67 of the brake cable 24.

The moving plate 56 is the part that gets pulled down in a pivoting motion when the brake cable 24 is pulled and forces the rubber type braking material 60 to touch the ground creating the friction, hence braking the skateboard 10.

The hole 39 at the end section of the metal bracket 30 and the one hole 62 on the moving plate 56 of the braking element 32 are connected by a spring by the spring 34 to keep the braking element 32 away from the ground when the brake 20 is not activated.

Figure 3A:
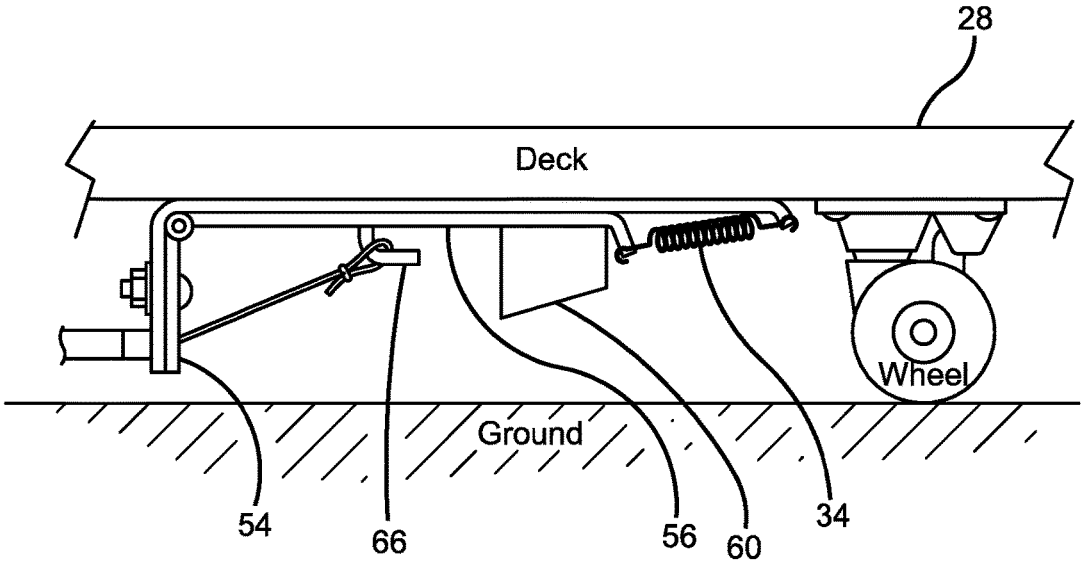
FIG. 3A shows a side view of the brake module when resting.
Figure 3B:
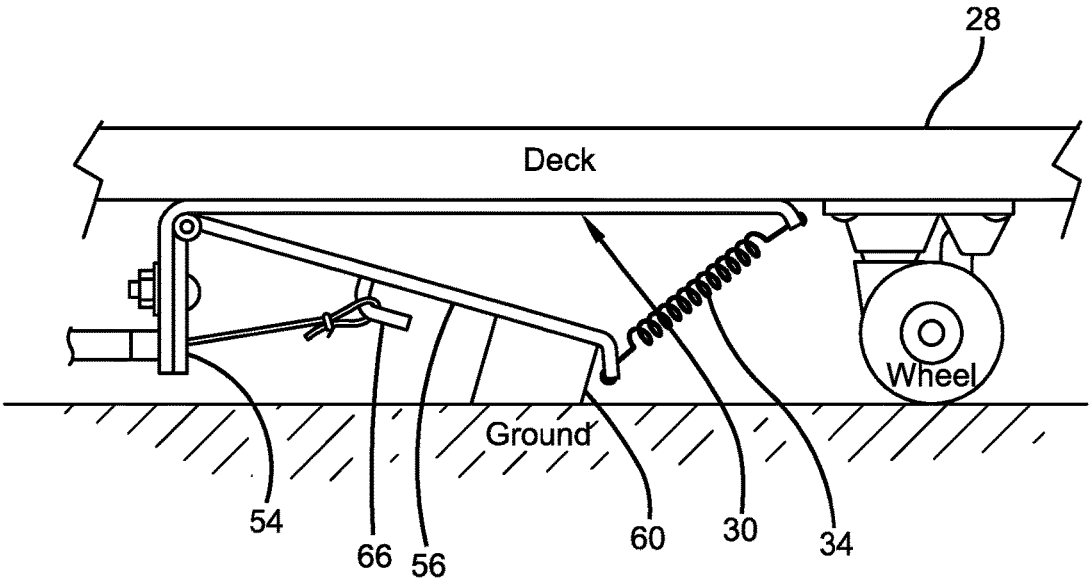
FIG. 3B shows a side view of the brake module when the brake is activated and the braking element lowered causing friction against the ground.

FIG. 3A and FIG. 3B show how the moving plate 56 in the brake module 26 changes its position when the brake 20 is activated.

Many changes and modifications in the above described embodiment of the invention can, of course, be carried out without departing from the scope thereof.

Accordingly, to promote the progress in science and the useful arts, the invention is disclosed and is intended to be limited only by the scope of the appended claim.

What is claimed is:

1. A skateboard comprising:

a deck;

a handle; and a hand brake system, wherein the hand brake system comprises:

a brake lever, wherein the brake lever is mounted on the handle;

a cable;

a brake module, wherein the brake module is mounted to an underside of the deck, wherein the brake module includes a braking element, wherein cable operatively connects the brake lever to the braking element, wherein the braking element is pivotable between an upper position and a lower position relative to the deck through activation of the brake lever, wherein the braking element contacts the ground upon which the skateboard moves to brake the skateboard when the braking element is in the lower position, wherein the brake module comprises an L-shaped bracket, wherein the bracket includes an upper portion and a lower portion, wherein the upper portion is mounted to the underside of the deck, wherein the lower portion depends downwardly from the upper portion, wherein the braking element is pivotally connected to the bracket, wherein the braking element includes first and second plates pivotally connected to each other by a hinge, wherein the first plate is mounted to the lower portion of the bracket and is fixed relative to the lower portion of the bracket, wherein the second plate is pivotable relative to the first plate between the upper position and the lower position through activation of the brake lever.

2. The skateboard of claim 1 further comprising a spring, wherein the spring is operatively connected to the braking element and the deck, wherein the spring keeps the braking element away from the ground in the upper position when the brake lever is not activated.

3. The skateboard of claim 1, wherein the second plate includes braking material, wherein the braking material comprises rubber, wherein the braking material contacts the ground upon which the skateboard moves to brake the skateboard when the second plate is in the lower position.

4. The skateboard of claim 1 further comprising a truck, wherein the truck is mounted to an underside of the skateboard, wherein the truck comprises a hanger, wherein the handle is fitted to the hanger.

5. The skateboard of claim 4, wherein the handle includes non-parallel upper and lower parts, wherein the lower part is parallel with the longitudinal axis of the deck, wherein the hanger includes opposite first and second ends, wherein the first end securely receives the lower part of the handle.

6. The skateboard of claim 5, wherein the hanger comprises a triangular piece, wherein the first end is located at a side of the hanger and the second end is located at a corner of the hanger.

7. The skateboard of claim 4, wherein the truck further comprises a plate shaped part mounted to the underside of the deck, wherein the plate shaped part is located between the hanger and the deck.

* * * * *